United States Patent [19]

Takatori et al.

[11] 4,120,251

[45] Oct. 17, 1978

[54] AUTOMATIC METHOD AND APPARATUS FOR CLOSING A TOE END OF A SEAMLESS HOSE MATERIAL UTILIZING A STRAIGHT LINE STITCHING BY MEANS OF A STATIONARILY DISPOSED SEWING MACHINE

[75] Inventors: Osho Takatori, Nara; Etsuo Nishikawa, Goze; Yosinobu Fukuyama, Kashihara, all of Japan

[73] Assignee: Takatori Machinery Works, Ltd., Yamatotakada, Japan

[21] Appl. No.: 717,133

[22] Filed: Aug. 24, 1976

[30] Foreign Application Priority Data

Jun. 11, 1976 [JP] Japan ..... 51-67598

[51] Int. Cl.[2] ..... D05B 19/00; D05B 21/00

[52] U.S. Cl. ..... 112/121.15; 112/262

[58] Field of Search ..... 112/121.15, 121.12, 112/121.11, 121.26, 262; 223/43, 112

[56] References Cited

U.S. PATENT DOCUMENTS

| | | | |
|---|---|---|---|
| 3,859,938 | 1/1975 | Fukuyama | 112/121.15 |
| 3,875,880 | 4/1975 | Hazelgrove et al. | 112/121.15 |
| 3,941,069 | 3/1976 | Fukuyama | 112/121.15 X |
| 3,952,673 | 4/1976 | Fukuyama | 112/121.15 |
| 4,020,775 | 5/1977 | King et al. | 112/121.15 |

FOREIGN PATENT DOCUMENTS

| | | | |
|---|---|---|---|
| 2,275,164 | 1/1976 | France | 112/121.15 |

*Primary Examiner*—H. Hampton Hunter
*Attorney, Agent, or Firm*—Kenyon & Kenyon

[57] ABSTRACT

This invention discloses a seamless hose material, which is used for a pair of seamless stockings or a pair of united panty stockings, wherein the toe portion of said hose material is united in such a manner that said toe portion can be toe-closed with a straight line stitching by means of a stationarily disposed sewing machine. When said material is travelling in a lateral direction, said material to be toe-closed is spread out and deformed so that the intermediate region of said spread out material is extended far from said toe.

8 Claims, 25 Drawing Figures

AUTOMATIC METHOD AND APPARATUS FOR CLOSING A TOE END OF A SEAMLESS HOSE MATERIAL UTILIZING A STRAIGHT LINE STITCHING BY MEANS OF A STATIONARILY DISPOSED SEWING MACHINE

The present invention relates to an automatic method and apparatus for uniting seamless hose so as to form the toe thereof for the manufacturing of toe-closed seamless stockings or united panty stockings and, more particularly, relates to an automatic method and apparatus for carrying out the toe-closing operation on a plurality of seamless hose materials arranged equally spaced from each other while travelling continuously said toe-closing operation can be carried out with a high degree of efficiency thus causing a device of the present invention to be a highly productive one.

It is well-known that several automatic apparatuses for sewing or closing the material at the toe of a seamless hose material (hereinafter, these apparatuses will be referred to as toe-closers) have been proposed for practical use in the hosiery industry. The apparatus disclosed in U.S. Pat. No. 3,941,069, is one of said apparatuses. In this apparatus, the toe end portion of the seamless hose material, which is already turned inside-out, is spread out and held by a pair of finger pieces, then gripped by a clamping member of a sewing machine, and thereafter, said finger pieces are retracted into their retracted positions. In this condition, the toe end portion is combined by means of a sewing machine, and then said toe-closed hose material is released from the grip of said clamping member. And finally the material is conveyed by a suction air flow to a successive working station, after said material has been turned from inside-out and back to its original side.

Recently, there has been an increasing tendency for people to wear the so-called panty-stockings made from synthetic fiber materials used for seamless stockings. In the process of manufacturing these panty-stockings, several automatic sewing machines for combining a pair of cylindrically-shaped hose materials to make the hip portion of the panty-stockings have been developed. Some of these sewing machines sold on the market are widely used.

However, a machine such as described in U.S. Pat. No. 3,941,069 has a production rate of only 400 dozens in eight hours. Further, even if this machine uses a stationarily disposed sewing machine and a clamping member which clamps the material from above and below while being turned so that the material is turned together with the clamping member so as to carry out a stitching operation, productivity is still limited due to the necessity to interrupt the lateral transversing motion of the material.

Furthermore, some of the recently used sewing machines employed as toe-closers, are provided with clamping members, so that the toe of the material can be closed or stitched in the form of a circular edge. Sometimes, the sewing machine itself is mounted on a swing device, so that the needle of said sewing machine can traverse along a circular passage.

It is very troublesome to turn a material, or to traverse a sewing machine along a given circular passage. These are two of the big drawbacks.

The object of the present invention is to obviate the drawbacks as mentioned above, and to make a toe-closed seamless hose which has a good configuration in the closed toe portion so that a consumer will accept such stockings as well-matching stockings of a proper size. In the present method, a material can be toe-closed by a straight line stitching after said material has been moved laterally, during which the material is properly deformed. By this way, a toe-closed seamless hose thus produced will have a good configuration for the toe portion as mentioned above. In this case, the cutting out of the waste portion from the toe-closed material can be carried out simultaneously together with the stitching operation. It is important to properly deform a toe portion of the material so that said deformed portion will have the best given pattern, and to stretch a connecting line disposed laterally between the body and the toe part by means of the finger pieces, wherein a point of the projection of a finger piece is arranged on a terminal end of said line, so that said stretched connecting line can be maintained in a straight line form. Afterwards, one point on said body situated on the intermediate region, especially on the center line of said material is positively displaced toward said body, so that said connecting line is deformed from a straight line to a curved line and deformed toward said body of the material.

Consequently, the stitched line on the seamless hose material of the present invention, is that of a straight line stitching. When said toe-closed seamless hose thus toe-closed by the above method is freed from the device of the present invention, such toe-closed seamless hose will have a toe-portion exhibiting a good configuration.

According to said good configuration of said toe portion, said toe must have a curved edge of a relatively small radius, so that the toe part made of a higher density fabric, is defined by the curved edge and the connecting straight line. In this configuration of the toe portion, such a toe part will entirely cover the top of the toes of the foot. If said connecting line shows a curved line of a larger radius, the nails of said toes will never be well-covered by said toe part of the higher density fabric.

In the present invention, by properly adjusting the amount of the longitudinal displacement of the hose guiding pin, the configuration of the toe-closed edge of the material can be varied, due to the radius of the curved edge being varied. By properly selecting said displaced amount of said pin, a toe-closed seamless hose of its optimum toe-part configuration can be easily manufactured by the method and apparatus of the present invention.

In addition to this, a stitched line is perpendicularly directed to the center line of the material, and this stitching can be carried out by moving said material laterally along a straight line passage. Consequently, when a plurality of such deformed seamless hose materials is arranged side by side, the toe-closing operation can be carried out one by one when moving said materials simultaneously and laterally. This means that there is no interruption of the lateral travelling of said materials, even when one of said materials is being toe-closed. An example of the time duration necessary for toe-closing a material using the device of the present invention is that of only an interval of two seconds. Therefore, a two second interval is necessary to feed a seamless hose material to said sewing machine. This means that it is expected that about a 50 percent speed-up is attained and, further, that the production rate may be as high as 600 dozens in 8 hours.

A method and apparatus for manufacturing a pair of toe-closed seamless stockings as mentioned above, can both be equally employed in the manufacturing of a pair of toe-closed panty stockings by means of the same process.

One united panty hose material, which consists of two adjacent legs, is mounted onto two adjacent units, each unit consisting of a holding member and a pair of finger pieces. One leg of said united hose material is arranged on one unit, and the other leg of said united hose material is arranged on the other adjacent unit.

A preferred embodiment of the invention will now be described by way of examples and with reference to the accompanying drawings, in which:

FIG. 8 (A, B, C) shows several arrangements of the holding member unit, wherein

Figure 9A:
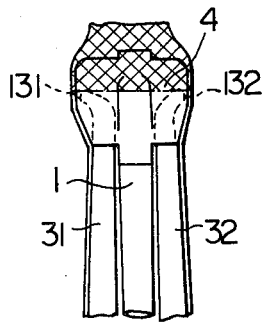
Figure 9B:
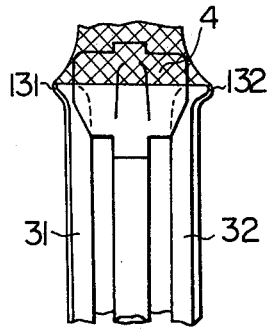
Figure 9C:
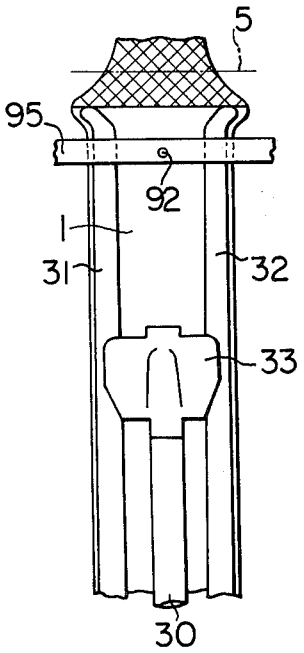
Figure 9D:
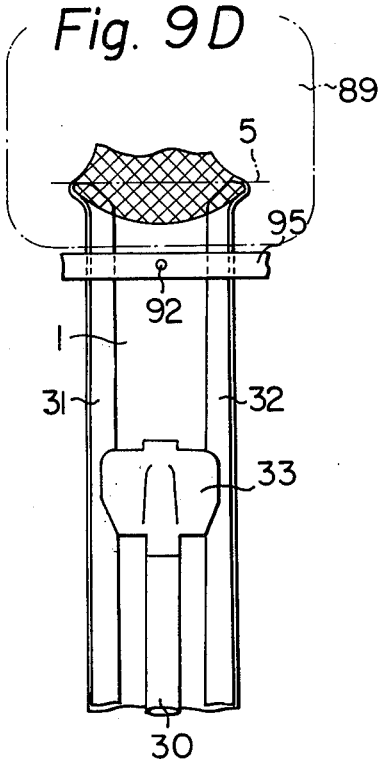
Figure 10:
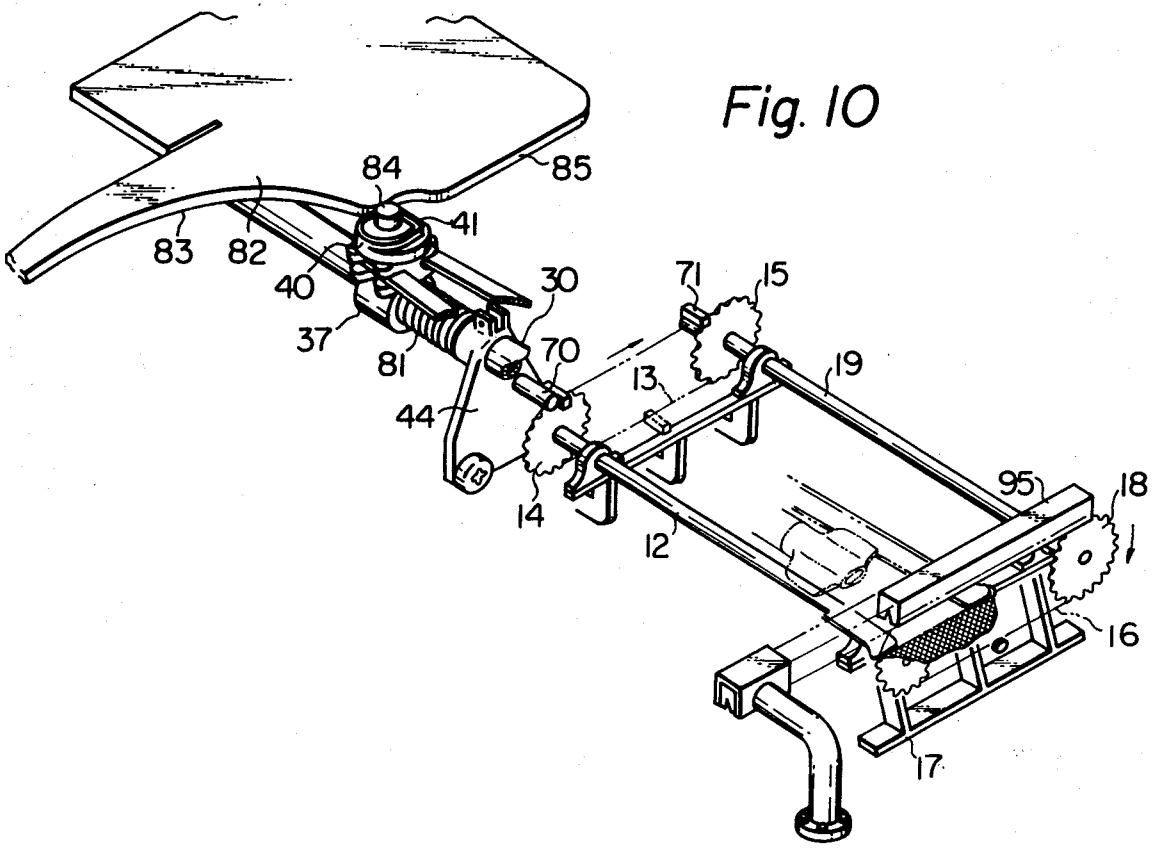
Figure 12:
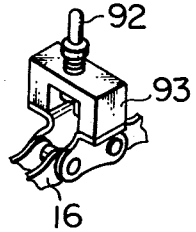
Figure 11:
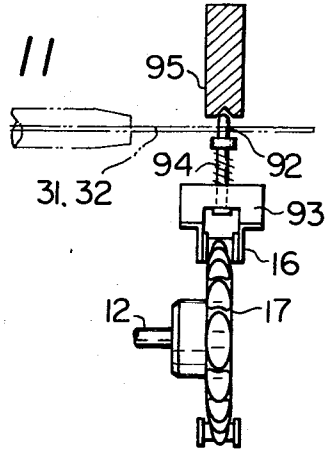
Figure 14:
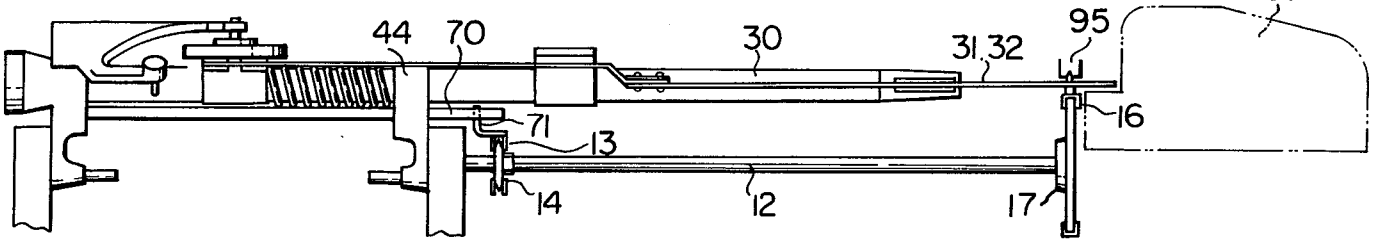
Figure 13:
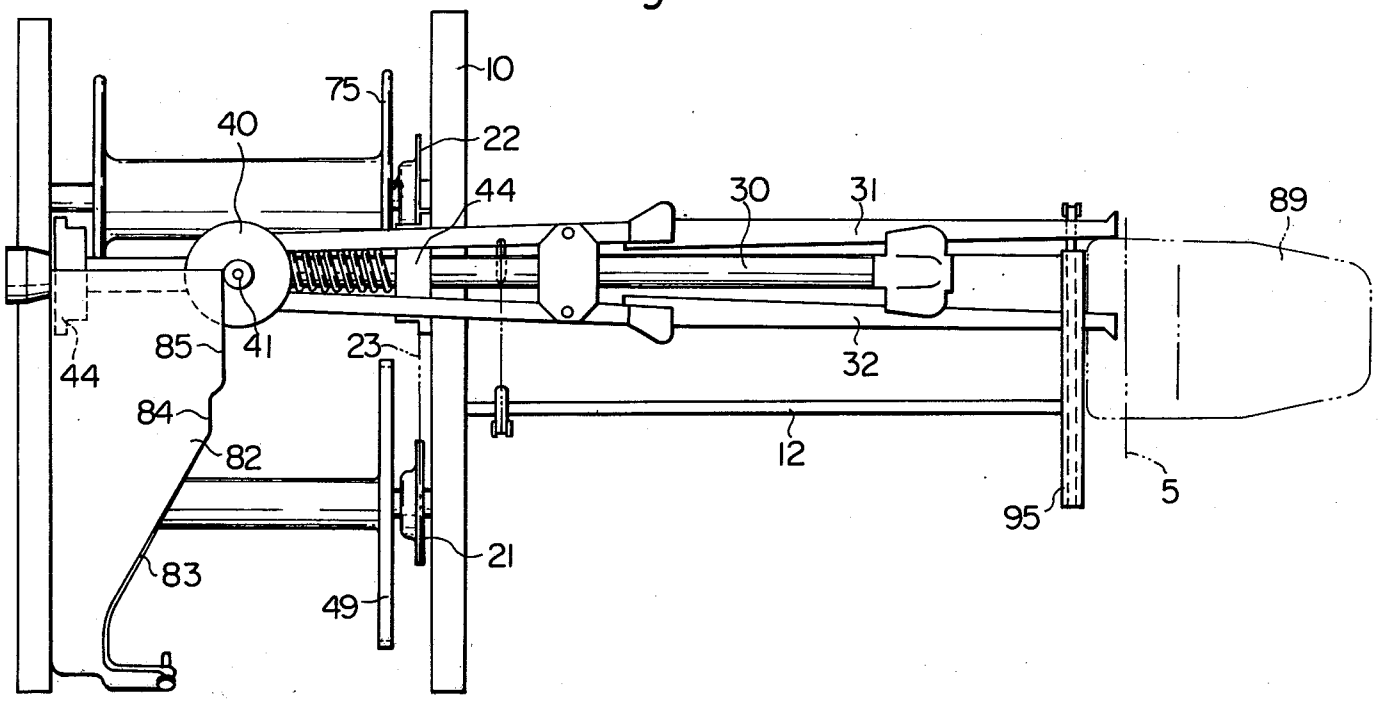
Figures 15, 16:
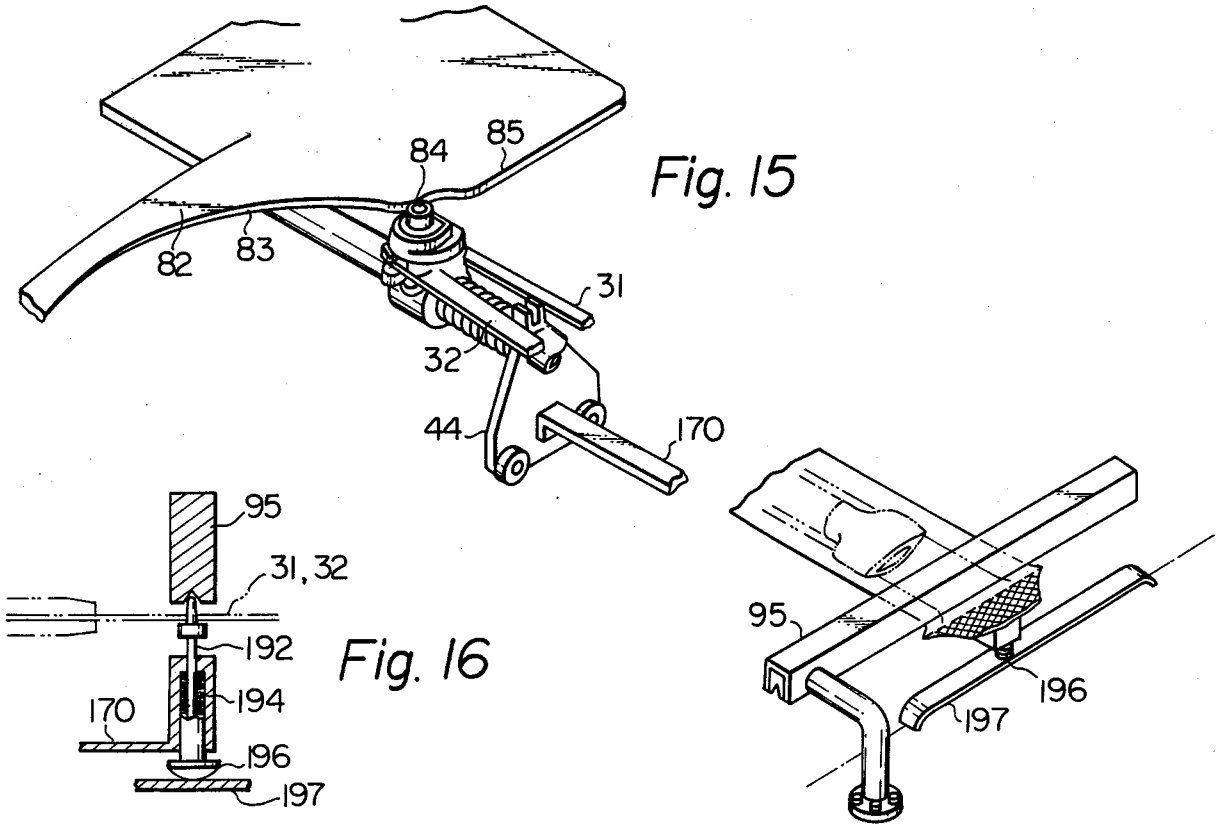
Figure 17:
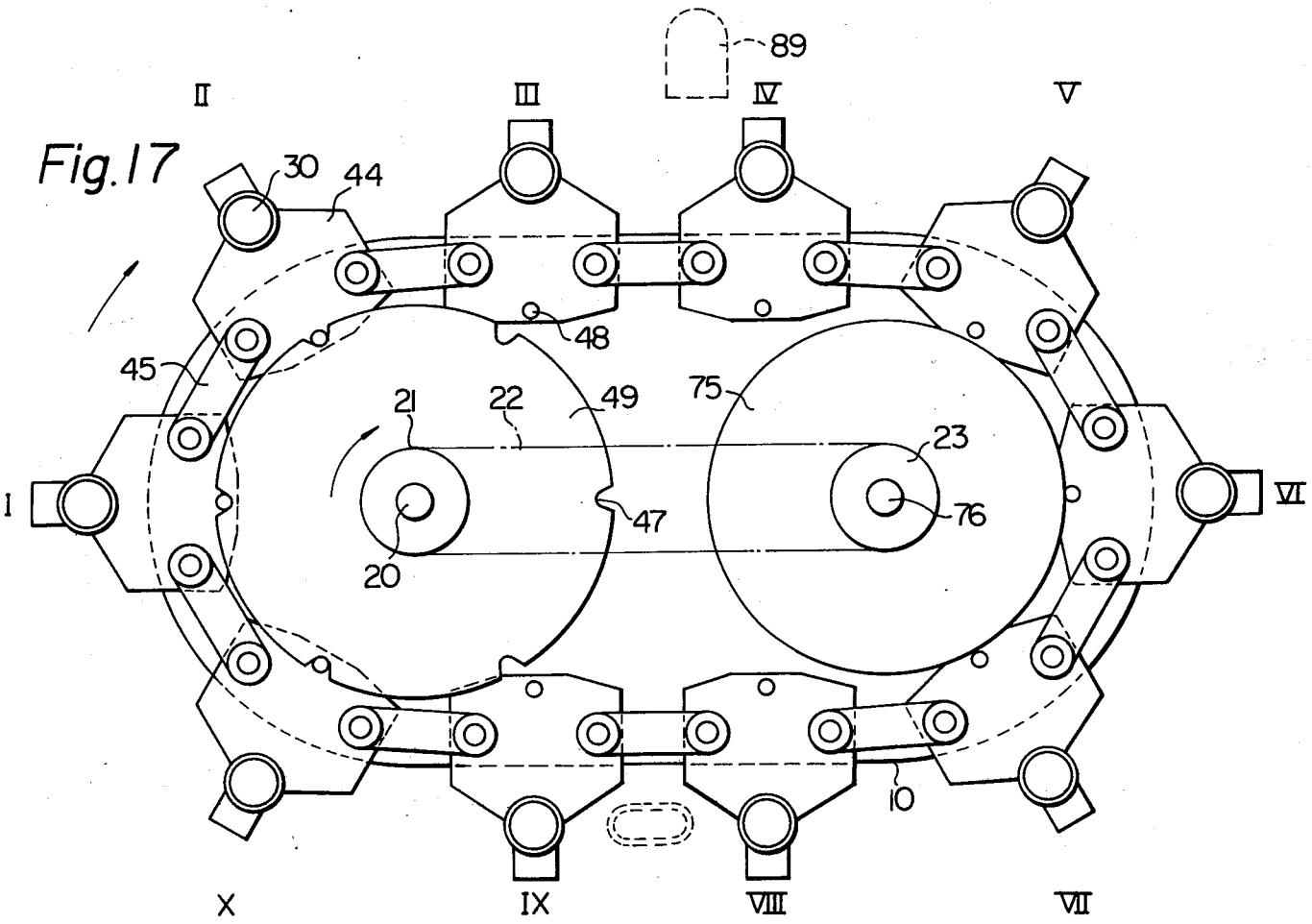
Figure 18:
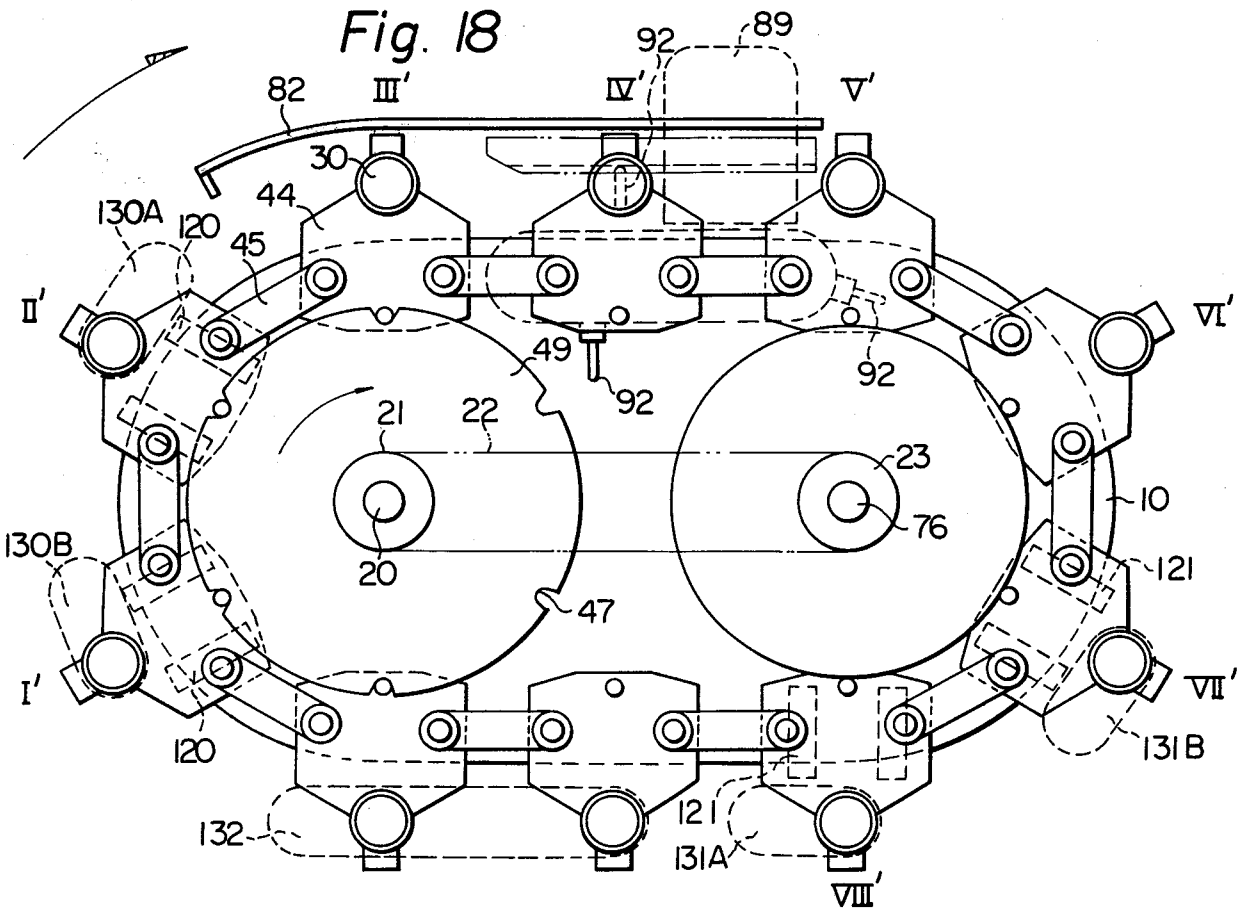
Figure 19:
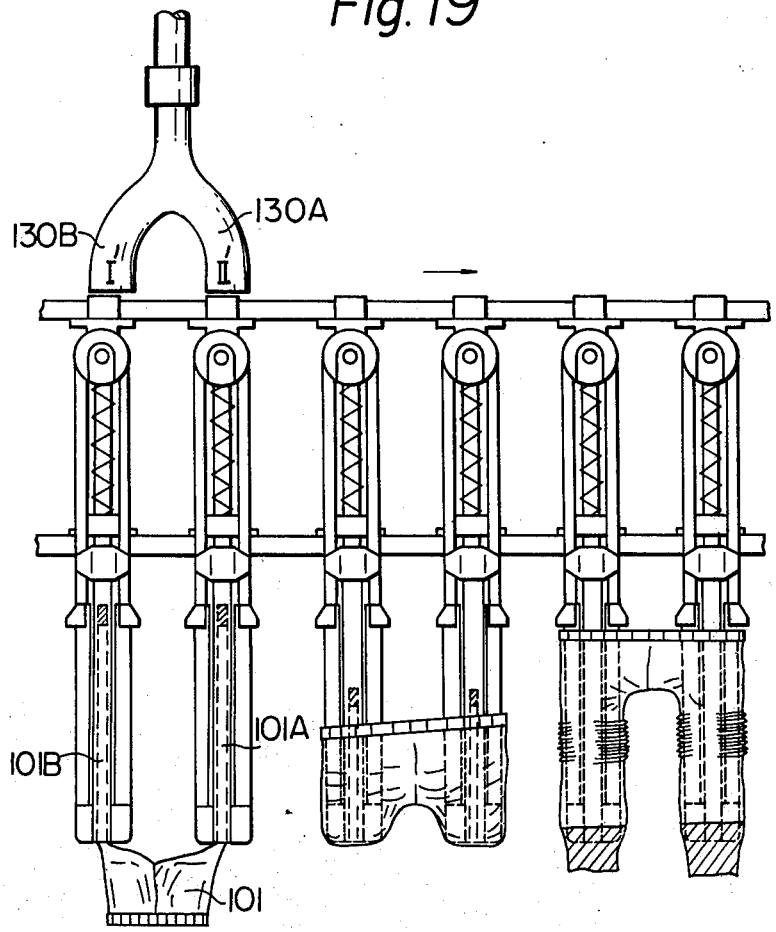
Figure 20:
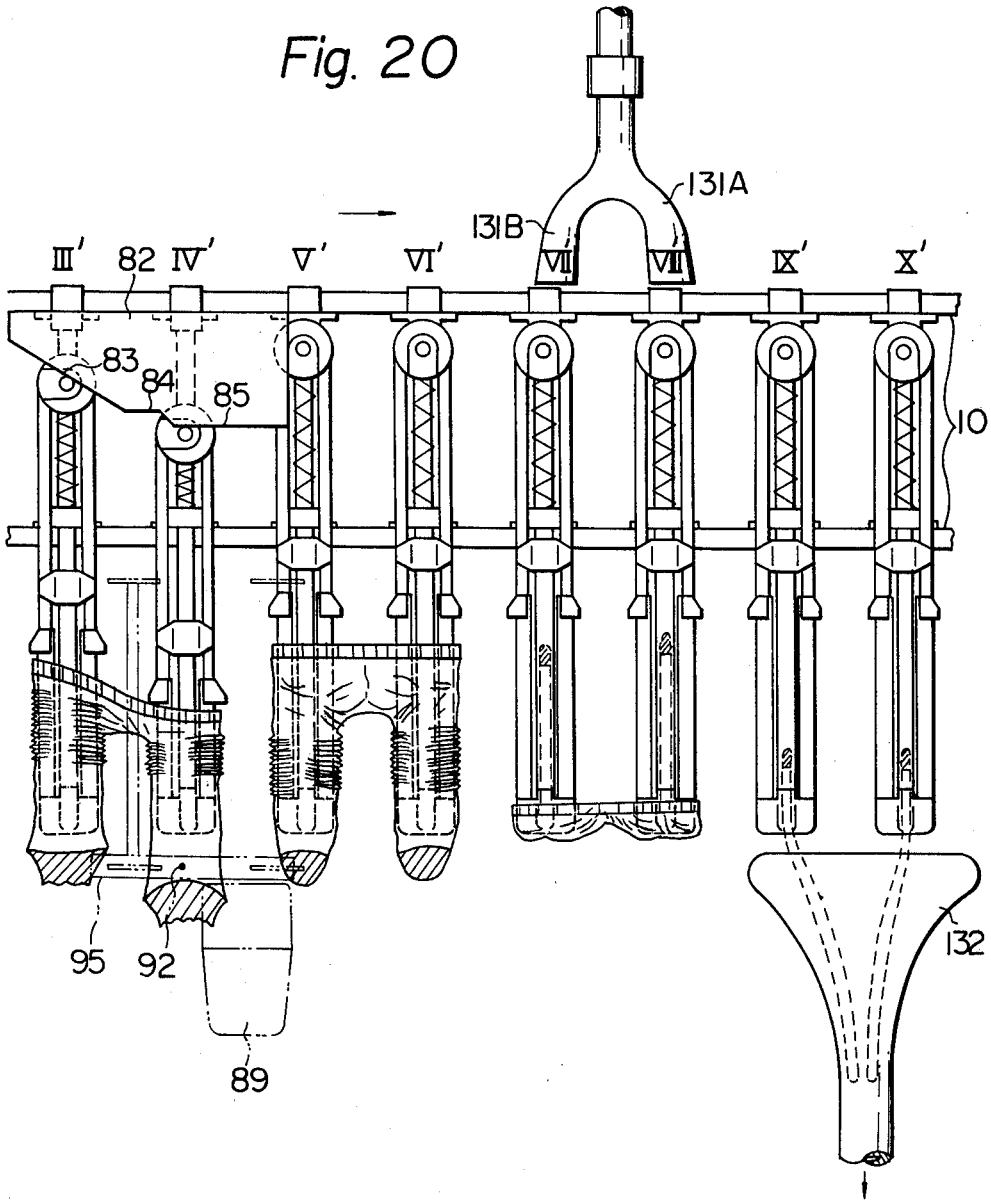

FIG. 9 (A, B, C, D) shows several arrangements of the device and the seamless hose from the position of readiness before stitching to the completed closed toe position, wherein FIG. 9A shows the arrangement at the position of readiness; FIG. 9B shows when finger pieces are spread laterally; FIG. 9C shows when a supporting pin is engaged with the seamless hose and; FIG. 9D shows when a straight line stitching is applied to said seamless hose;

FIG. 10 is a perspective view of a device of the present invention;

FIG. 11 is a sectional view corresponding to FIG. 9C and 9D;

FIG. 12 is a perspective view of a hose guiding pin used for the device as shown in FIG. 10;

FIG. 13 is a plan of a device as shown in FIG. 10;

FIG. 14 is a side view of a device as shown in FIG. 10;

FIG. 15 is a view similar to FIG. 10, showing another embodiment of the present invention;

FIG. 16 is a sectional view similar to FIG. 11, showing a device as shown in FIG. 15, and;

FIG. 17 is a diagrammatic side view of a toe-closing machine installed with a device of the present invention;

FIG. 18 is a view similar to FIG. 17, which shows a toe-closing machine for the manufacturing of toe-closed panty stockings;

FIG. 19 is a developmental plan of a part of a machine in FIG. 18, ready for the toe-closing process;

FIG. 20 is a plan similar to FIG. 19, which indicates the toe-closing process and the following process for removing a pair of toe-closed panty stockings from the machine.

Figure 1:
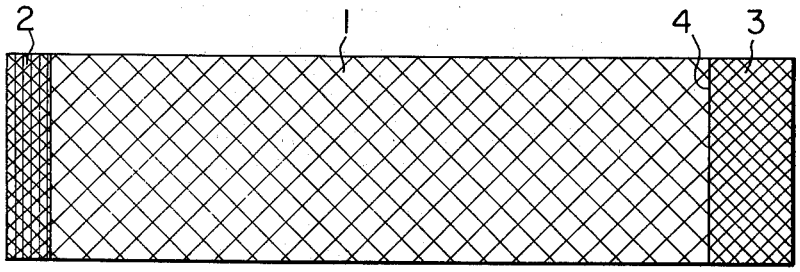
FIG. 1 is an outside view of a seamless hose before closing the toe.
Figure 2:
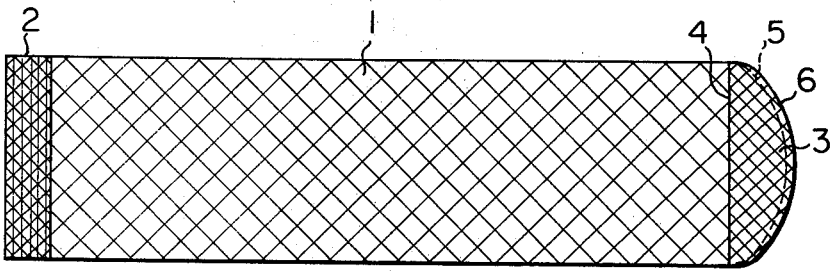
FIG. 2 is a view similar to FIG. 1, and shows a good seamless hose after closing the toe.

In FIG. 1, a raw material for a seamless hose to be toe-closed by a device of the present invention or by a similar toe-closer, consists of a leg 1 of the hose, a welt part 2 containing rubber yarns and a toe part 3 connected to one edge of said leg 1 by a connecting line 4. FIG. 2 shows a toe-closed seamless hose with a good toe-closed edge manufactured from said material as shown in FIG. 1. It is clear that the connecting line 4 shown in both FIG. 1 and FIG. 2 is a straight line situated at the same position on the material.

Figure 3:
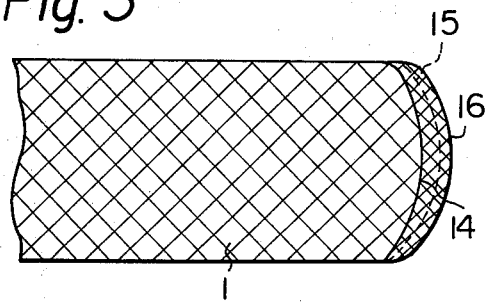
FIG. 3 is a view similar to FIG. 2, showing a defective seamless hose after poorly closing the toe.

The toe-closed part 3 is defined by a connecting line 4 and by a curved edge which is provided with a similar stitched line 5 and a cut edge 6. When wearing thus made seamless hose, said toe-closed part 3 can be placed just over the tips of the toes, thus said tips of the toes are concealed from sight due to the toe part 3 being made of a high density fabric. If the toe-closed part 3 shows a crescent shape, some parts of said tips of the toes become covered by the leg 1, said leg 1 being made of lower density fabric than that of the toe part 3. Such condition is not satisfactory to the wearer. Consequently, the present invention is aimed toward the manufacturing of the toe-closed seamless hose as shown in FIG. 2 and not as shown in FIG. 3. Furthermore, such toe-closed seamless hose can be made by stitching the material along a straight line, and not along a curved line.

Since the knitted construction of the seamless hose has a good elasticity, said hose can be easily deformed to follow the shape of the pattern or the edges of the finger pieces which are opened laterally after said pattern or finger pieces have been inserted within said hose. Consequently, such characteristics of good elasticity are beneficial to the method of the present invention. After deforming the connecting line 4 toward the leg by a given distance, said material is stitched along the straight line defined by both terminal ends of the connecting line 4; the cut edge 6 of the toe-closed part 3 is formed parallel to said straight line; and then said material is freed so that it will be able to resume its original condition. At the instant it is freed, the deformed connecting line 4 is restored to its original straight line, due to the good recovering ability of the material.

After said material has been freed, the toe-closed edge having a curved line of a small radius can be formed, thus causing the stitched line 5 and the cut edge 6 to have a similar curve as that of the toe-closed edge.

Figure 4:
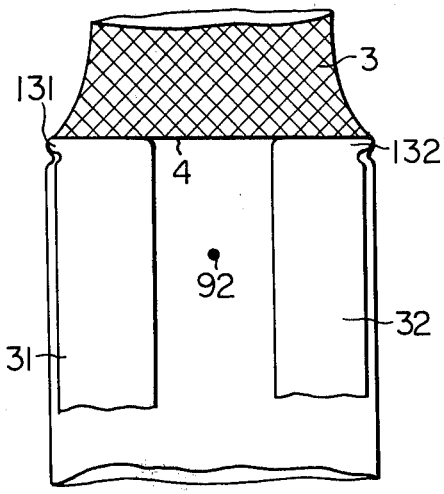
FIG. 4 is an enlarged side view showing the state ready for stitching in the present device.
Figure 5:
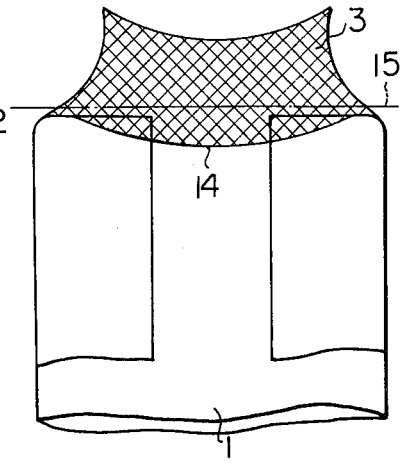
FIG. 5 is a view similar to FIG. 4, showing a poor condition ready for stitching in the known device.
Figure 6:
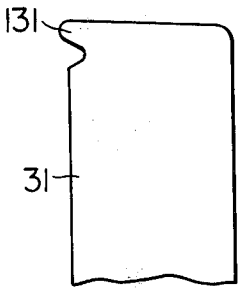
FIG. 6 is a side view of a top part of a finger piece of the present invention.

One of the important factors in manufacturing a seamless hose with a connecting line 4 which is straight during its free condition, is that first, the connecting line 4 must also be a straight line when the material of the hose configuration is spread out laterally. Such condition cannot be realized when finger pieces with straight side edges, are commonly used as conventional toe-closers. If such straight side edged finger pieces are used, the spread material develops such a configuration as shown in FIG. 5, in which a connecting line shows a curved line 14. Consequently, in the present invention, by using finger pieces provided with outwardly projecting points 131 and 132 at the top, and arranging said points 131 and 132 on the terminal ends of the connecting line 4 from the inside of said material, the connecting line becomes a straight line as shown in FIG. 4 after said material is spread out laterally. The configuration of the top of the finger piece suitable for realizing said condition as in FIG. 4 is shown in FIG. 6. However, it is never restricted to this configuration only. One example of the configuration as shown in FIG. 6 has a dent.

Figure 7:
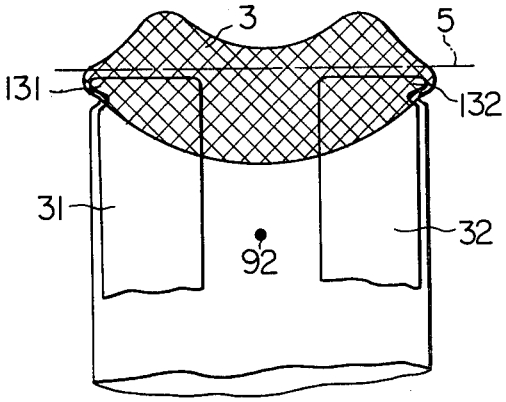
FIG. 7 is an enlarged side view similar to FIG. 4, showing a completed state of stitching in the present device.

After a material is held by said finger pieces as shown in FIG. 4, the body of said material comes to engage with a hose guiding pin 92 at one point on said body 1, which point is situated on the center line of said material and separated at a given distance from the connecting line 4. When said separated distance has increased, the material is then deformed as shown in FIG. 7. In this state, said connecting line 4 showing a curved line as well as a toe part 3 is also largely deformed. By sewing said deformed toe part 3 along a straight stitching line which extends between the two terminal ends of said connecting line, or is slightly separated from said extending line, a stitched line for a toe is formed on said material, at the same time, a cut edge (not shown in FIG. 7) disposed near said line can be formed by cutting out the waste portion from said material by means of using scissors.

By restoring said displaced hose guiding pin 92, said connecting line 4 now becomes a straight line due to the recovering ability of said material. Consequently, after said hose guiding pin 92 is separated from said seamless stocking body 1, and the laterally spread-out condition of said material by means of finger pieces is freed from being held by the finger pieces after said finger pieces are retracted from the laterally spread condition, the toe-closed seamless hose as shown in FIG. 2 is obtained. In one example, the distance of 15 mm is enough for the displacement of said hose guiding pin for manufacturing a toe-closed seamless hose with a good toe-closed edge.

In this case, if said finger pieces with straight line side edges are used instead of the finger pieces shown in FIG. 6, even if said material is deformed properly by said hose guiding pin 92 and also closed by a straight line stitching, the deformed material will retain the pattern as shown in FIG. 5 after it has been freed from the held condition. Said toe-closed seamless host must have a toe-closed part as shown in FIG. 3, wherein a stitched line 15 is curved, although such a toe-closed seamless hose is by no means a good one. By using a hose guiding pin 92 (shown in FIG. 4), it becomes possible to deform a toe part 3 of the seamless hose material to a given amount, to stitch toe part 3 on or near by a straight line and to form a straight stitched line 5. When a thus toe-closed seamless hose is freed from its held condition, a good toe-closed seamless hose as shown in FIG. 2 can be manufactured by the method of the present invention.

As indicated in FIG. 17, an apparatus for carrying out the above functions employs a stationarily disposed sewing machine 89 and a plurality of holding members which are mounted via brackets 44 on a frame 10 in an endless loop fashion. As shown, the brackets are interconnected by links 45 and are driven such that the holding members are moved along the frame 10 laterally to the front of the sewing machine 89. As shown in FIGS. 13 and 14, each of the holding members, in addition to the bracket 44, employs a suction tube 30 which extends perpendicularly to the frame 10 and to the sewing machine 89.

Figures 8A, 8B, 8C:
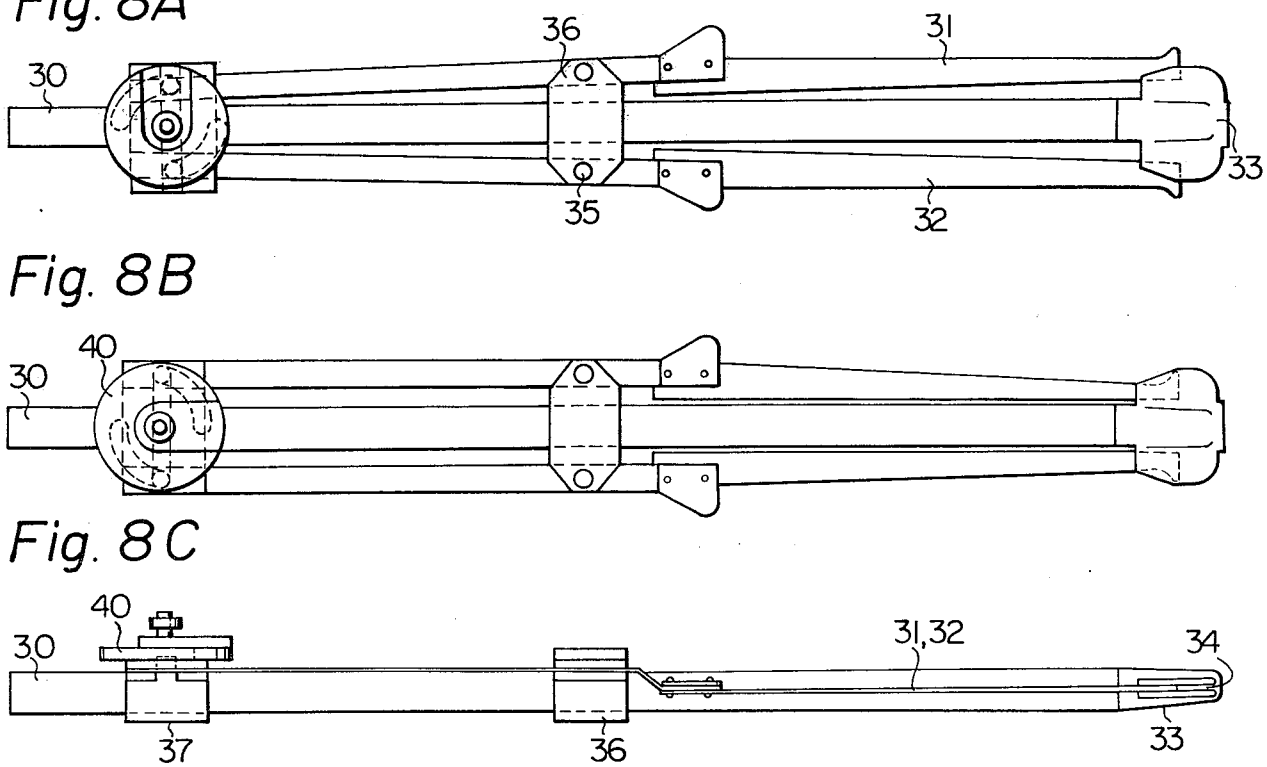
FIG. 8A shows when finger pieces are spread laterally.
FIG. 8B shows, when said finger pieces are closed.
FIG. 8C shows the side view of said holding member unit.

The detailed construction of the holding member is shown in FIGS. 8A, 8B and 8C. Referring to these figures, at the top of the suction tube 30, a support member 33 is fixedly mounted. The support member 33 is provided with two guide slits 34 (as shown in FIG. 8C) arranged symmetrically as shown in FIG. 8A. In FIG. 8C, a front sliding member 36 and a back sliding member 37 are mounted slidably in one unit on said suction tube 30. A pair of finger pieces 31, 32 is pivotally mounted on both sides of the front sliding member 36 by means of pins 35, while the front part of said pieces is slidably engaged with the two guide slits 34 of the support member 33. A circular plate 40 is mounted on said back sliding member 37, which acts to induce a relative displacement, i.e., to open or close the front part of said pieces 31 and 32 by a turning movement of said plate 40. This causes the finger pieces 31, 32, to pivot about the pins 35. Consequently, after turning a quarter turn of said plate 40, the front part of said pieces 31 and 32 is displaced as shown in FIG. 8A (i.e., its opened condition). When said plate 40 turns in a reverse direction, then the front part of the finger pieces 31 and 32, is restored to its ready position as shown in FIG. 8B. Since said pair of finger pieces 31 and 32, said front sliding member 36, and said back sliding member 37 are so constructed in one unit, said unit is displaceable along the extended longitudinal axis line of the suction tube 30.

Several steps of this toe-closing operation are shown in FIG. 9. A material turned inside-out, is covering a holding member as shown in FIG. 8B. In this case, as shown in FIG. 9A, the connecting line 4 on said material is arranged at the region defined by the top of said finger pieces 31 and 32, in such a manner that said connecting line 4 is to be laid on the line extending between the projecting points 131 and 132 of said finger pieces 31 and 32.

When said finger pieces 31 and 32 are opened as shown in FIG. 8A, said seamless stocking material is spread out laterally, thus, the toe part is deformed as shown in FIG. 9B. Keeping this condition, said unit is displaced longitudinally along the extended axis line of said suction tube 30, until the displacement between said unit and said suction tube reaches the distance as shown in FIG. 9C. In this condition, a hose guiding pin 92 comes into contact with a body of said material at a point on a center line of said material, so that said leg 1 engaging with said pin 92 can be retained there. Then, said finger pieces are displaced forwardly again at a suitable distance, as shown in FIG. 9D, thereby deforming the toe part 3 of said member as shown in FIG. 7. By making a stitched line 5 (FIG. 9D) on said material along a straight line by means of a sewing machine, the toe-closing operation is completely accomplished.

One embodiment for carrying out these steps of the method of the present invention is shown in FIGS. 10 through 13.

In FIG. 10, each suction tube 30 is fixedly mounted on a bracket 44 which travels along the frame 10 (as shown in FIG. 13) of the toe-closer, i.e. laterally of the frame 10 such that the center line of said suction tube 30 is perpendicular to the travelling direction of said bracket 44 along said frame 10. This bracket 44 is arranged at the middle of said suction tube 30 between said front sliding member 36 and said back sliding member 37 (as shown in FIG. 8). A spring 81 is located between said bracket 44 and said back sliding member 37 (FIG. 8). On said back sliding member 37 (FIG. 8), a cam roller 41 is rotatably mounted, while a cam plate 82, provided with three cam surfaces 83, 84 and 85 which come in contact with said cam roller 41, is fixedly mounted on said frame 10 of said toe-closer.

According to the traversing of the bracket 44 toward the right direction in FIG. 10, firstly, the cam roller 41 comes into contact with the stationary cam surface 83, and said cam surface 83 acts to push said unit forward along said suction tube 30 overcoming a spring force of the spring 81. When said cam roller 41 comes into contact with the cam surface 84, the relative arrangement of said unit and said suction tube 30 becomes as that shown in FIG. 9C. When said cam roller 41 comes into contact with the cam surface 85, said arrangement becomes as that shown in FIG. 9D. Consequently, said cam roller 41 is maintained in contact with said cam surface 85 for as long as it takes for the toe portion of said material to be toe-closed and stitched completely by a stationarily disposed sewing machine. Thus, the cam 82 is stationary while the roller 41 rolls over the cam surface 83. The cam 82 does not move with respect to the follower 41, instead, the cam 82 is fixedly mounted on the frame 10.

Between the frame 10 and a sewing machine 89 as shown in FIG. 13, a chain driving shaft 12 with front and back chain wheels 14 and 17, is rotatably mounted on said frame. It is preferable that, such shaft 12 is arranged to coincide with a line passing through the middle point on said cam surface 84 of said cam plate 82. Another follower shaft 19 with front and back chain wheels 15 and 18 provided with the same number of teeth as those of the chain wheels 14 and 17, respectively, is rotatably mounted on said frame, wherein the center line of said shaft 19 lies on a vertical plane containing the side edge of the cam surface 85 or slightly in front of said cam surface 85. Over such pairs of chain wheels 14 and 15 and also 17 and 18, endless chains 13 and 16 are engaged, respectively.

On said endless chain 13, a plurality of equally spaced driven members 71 is mounted, while one driving projection 70 is projected from said bracket 44, so that said projection 70 pushes said driven member 71. Consequently, according to the traversing of the bracket 44, the driven member 71 on said chain 13 moves at the same speed and also toward the same direction as that of said bracket 44.

On said endless chain 16, the same number of equally spaced pin holders 93 (FIGS. 11 and 12), as that of said driven members 71 as shown in FIG. 10, are mounted. A hose guiding pin 92 is held vertically on said pin holder 93 as shown in FIG. 11, wherein said top of the pin 92 is directed vertically and outwardly within the plane of the endless chain 16, and said pin 92 is held slidably within the hole of said pin holder 93.

The normal position of said pin 92 against the holder 93 is maintained by arranging a spring 94 between them, so that the length of the portion of said pin 92 projecting from the holder remains constant, otherwise it can be pushed down by other members. However, when some downward force is affecting said pin 92, said pin 92 can slide downwardly within the hole of said pin holder 93. There is provided a guide rail 95 with a V-shaped groove, within the vertical plane of said endless chain 16. Said guide rail 95 is arranged at a level above the level of the finger pieces 31 and 32. Consequently, in FIG. 10, when cam roller 41 comes into contact with the middle point of the cam surface 84, and the driving projection 70 on the bracket 44 comes into contact with one of the driven members 71 of the endless chain 13, the hose guiding pin 92 then becomes situated within the vertical plane containing the axis of said shaft 12. Thus, as shown in FIG. 9C, when said hose guiding pin 92 pushes upwardly against a point situated on the center line of said material with the cooperation of said guide rail 95, said pin 92 prevents the middle portion of the toe part 3 of the seamless hose material from being pulled forwardly, as shown in FIGS. 7 and **9*b* while both side portions of the middle of the hose material can be moved forwardly with respect to the forward movement of said unit of suction tube 30 and finger pieces 31, 32. After said unit is moved, the material is deformed into such a pattern as shown in FIG. 9D, said pattern is maintained from the time said cam roller 41 comes into contact with the left end of said cam surface 85 in FIG. 10, to the time at which said cam roller 41 reaches said right end of said cam surface 85. When a holding device together with a seamless hose material travels along a straight line of the frame 10 and moves laterally to the center line of said material, said material is then stitched as shown in FIG. 7, by means of a stationarily disposed sewing machine, thus forming a stitched line 5 of a straight line on said material. In FIG. 10 as said bracket 44 travels farther and as said cam roller 41 comes out of contact with said cam surface 85, said pin 92 becomes disengaged with said material, because said hose guiding pin 92 on said endless chain 16 is already in its tilted condition. As said unit is moved farther from a sewing machine by the action of said spring 81, said toe-closed seamless hose is drawn onto the suction tube 30**.

Finally, the toe-closed edge of said seamless hose becomes engaged with the front edge of a support member 33 (FIG. 9), thereby preparing a toe-closed seamless hose for suction into said suction tube 30. After said stitched line 5 of a straight line is formed on the deformed toe part 3 and said toe-closed seamless hose is freed from the device of this invention, a seamless hose with a toe-closed edge of an arc-shape as shown in FIG. 2 is manufactured. Since said stitched line 5 must be a straight line when it is stitched by a sewing machine, a sewing machine such as sewing machine 89 (FIG. 13) being utilized must be a stationarily disposed conventional mechanism.

In FIGS. 15 and 16, another embodiment operating similarly to the device mentioned above as shown in FIGS. 10 through 12, utilizes two endless chains 13 (FIG. 10) and 16 (FIG. 10) and also a hose guiding pin 92 (FIG. 9).

In FIG. 15, instead of using a conveyor chain arrangement to move the pin 92, each bracket 44 may have a forwardly projecting supporting member 170 for directly supporting a pin 192. As shown in FIG. 16, the pin 192 is mounted at the front end of the member 170 in such a manner that the top point of said pin 192 can be engaged within the groove of the guide rail 95, and a spring 194 (FIG. 16) is so arranged that the top point of said pin 192 is sunken into said member 170 by the force of said spring 194. The bottom end of said pin 192 also has a head 196. Below the finger pieces 31 and 32 and the guide rail 95, a guide plate 197 is disposed in parallel to said guide rail 95. When a head 196 comes into contact with the upper surface of said guide rail 95, said pin 192 is pushed upwardly against the force of said spring 194. The above condition is maintained for as long as, said pin 192 is sliding along the surface of said guide plate 197, according to the lateral movement of the bracket 44. In this case, as shown in FIG. 16, the top point of said pin 192 projects upwardly from the level of said finger pieces 31 and 32, and engages in the groove of said guide rail 95. Consequently, when said bracket 44 (FIG. 15) travels along the frame 10 under the influence of the structure as indicated in FIG. 17, said corresponding unit of suction tube and finger pieces, said seamless hose material, and said pin 192 are altogether displaced laterally along said guide rail 95. By this lateral displacement, similar to that of the embodiment shown in FIG. 10, stitching a stitched line 5 (FIG. 2) of a straight line, can be carried out.

One toe-closer machine provided with the device of the present invention is shown in FIG. 17. In FIG. 17, ten separate brackets 44 are distributed along an oval passage, which is provided on a frame 10. Said brackets are connected by chain links 45 so that said brackets and links are formed into one endless chain. On this frame 10, a main driving shaft 20 and a follower shaft 76 are rotatably mounted on the frame 10 at both centers of said oval passage, respectively. On said main driving shaft 20 two driving drums 49 are fixedly mounted, while on said follower shaft 76, two follower guide drums 75 are also fixedly mounted, for pushing or guiding said brackets 44. By a driving chain wheel 21 mounted on said main driving shaft 20 and a follower chain wheel 23 mounted on said follower shaft 76, the turning motion of said main driving shaft 20 is transmitted to that of said follower shaft 76 via an endless chain 22.

Said pair of driving drums 49 has a plurality of dented grooves located along its peripheral surface. Each bracket 44 also has a projection 48, which is engageable within said dented groove 47 such that said bracket 44 can be pushed by said pair of driving drums 49. Consequently, in the case as shown in FIG. 17, three brackets are pushed so that they travel along its oval passage when the drum rotates together with the main driving shaft 20 maintaining the engagement of three projections 48 with three dented grooves 47, respectively. In FIG. 17, each of the ten symbols of I, II, III, IV, V, VI, VII, VIII, IX and X, shows a specified position of one of said brackets 44.

When one of said brackets 44 is being moved from position I to position II, the operator picks up the welt portion of a seamless hose material, and holds its toe end in front of the suction tube 30 of the holding unit. Then said seamless hose material is sucked into the suction tube 30 by a pneumatic force. After stopping said pneumatic force, said welt portion of said material is placed over the free end portion of the support member 33 of said holding unit. Some of said material not yet covering said holding unit is automatically drawn over the outside of said suction tube 30; thus, said seamless hose material is turned inside-out. In this case, it is necessary to keep the toe part of said seamless hose material from being placed on said holding unit.

When one of said brackets 44 is being moved from position II to position III, a pair of finger pieces 31 and 32 is separated, so that the toe part of said material into which said pair of finger pieces is inserted, is spread out laterally. Then said finger pieces together with said seamless hose material are advanced toward a sewing machine 89. After completion of said forwarding movement, a hose guiding pin (92 or 192) becomes engaged with said material, such that one point of said material is being pushed upward by said pin (92 or 192).

When one of said brackets 44 is being moved from position III to position IV, said finger pieces 31 and 32 are further advanced toward said sewing machine 89, until the line on the toe part of said material to be stitched thereon enters into the stitching position of said sewing machine 89 during this time, the hose guiding pin (92 or 192) remains engaged with the material, as indicated in FIGS. 7 and 9*d*, so that the toe part is deformed. As indicated, the line between the toe part 3 and the remainder of the hose is deformed into a curvilinear shape. By laterally traversing said finger pieces 31 and 32 together with said material as well as by the operation of said sewing machine, a stitched line 5 is formed on said toe part and also a cut edged is formed. Thereafter, the pin (92 or 192) is moved out of engagement with the hose.

When one of said brackets 44 is being moved from the position IV to the position V, said finger pieces 31 and 32 are moved far from said sewing machine and, also, they are retracted into a member of the suction tube.

When one of said brackets 44 is being moved from the position V to the position VI, said welt portion of said seamless hose is positively drawn into said suction tube 30.

When one of said brackets 44 is being moved from the position VI to the position VII, the toe of said toe-closing seamless hose is sucked into said suction tube 30 by a pneumatic force, and then a part of said toe-closed seamless hose remaining on said holding unit is sucked into said suction tube 30, so that it is turned from inside-out and back to its original side.

When one of said brackets 44 is being moved from the position VII to the position IX, said toe-closed seamless hose in its correct side out is pneumatically transported to the downstream working station.

As disclosed above, a rotatable clamping device of a special type of sewing machine, which clamps the toe part of the seamless hose material from above and below and which is indispensable to a conventional toe-closer can be dispensed with in the method and the apparatus of the toe-closer for carrying out said present invention. Therefore, in the toe-closer of this invention, a stationarily disposed conventional sewing machine can be employed, and furthermore, said machine is sufficient for laterally moving said toe-part to be toe-closed alone a straight line. This means that the toe-closing operation can be carried out with much simplicity, steadiness, and high speed.

We have already disclosed the details for the process of toe-closing a seamless hose material for the manufacturing of toe-closed seamless stockings. However, this device can also be well applied to the process of toe-closing a panty hose material for the manufacturing of toe-closed panty stockings.

In FIG. 19, a seamless panty hose material 101 consists of two pieces of hose or leg portions 101A, 101B which are always united into one piece of material. Consequently, said seamless panty hose material must be simultaneously mounted onto two adjacent suction tubes 30 in such a manner that, when two adjacent brackets 44 are being moved from portion II′ to portion III′ or from portion I′ to portion II′, respectively, the operator must pick up the united portion of said seamless panty hose material and hold their toe ends in front of the respective suction tubes 30. Then, the legs 101A, 101B of said seamless panty hose material 101 are sucked into the two adjacent suction tubes 30, respectively, by a pneumatic force by means of the suction tubes 130A, 130B, as shown in FIGS. 18 and 19. After stopping said pneumatic force, the united portion of said material is placed over both adjacent free end portions of the support member 33 of said adjacent holding units. A part of said material not yet covering said holding units is automatically drawn over the outside of said suction tube 30 by means of two pairs of drawing in rollers 120, as shown in FIG. 18. Thus, the legs 101A, 101B of said seamless panty hose material are turned inside-out. In this case, it is necessary to keep the toe portions of said seamless panty hose material from being placed on said holding units.

When one of said brackets 44 is being moved from position II' to position III', while another one of said brackets 44 is being moved from position I' to position II', a pair of finger pieces 31 and 32 of the former bracket is separated, so that the toe part of said material, into which said pair of finger pieces is inserted, is spread out laterally. Then, said finger pieces together with said legs 101A of the seamless panty hose material 101 are advanced toward a sewing machine 89. After completion of said forwarding movement, a hose guiding pin (92 or 192) becomes engaged with said material, such that one point of said material is being pushed upward by said pin (92 or 192). When the latter bracket is being moved from portion I' to portion II' and the former bracket is being moved from portion II' to portion III', there is no separating of said pair of finger pieces 31 and 32 of the latter bracket. However, when this latter bracket is being moved from portion II' to portion III', leg 101B of said panty hose material 101 is then affected by another pin (92 or 192), which is functioning in the same manner as that for leg 101A.

Consequently, leg 101A is followed by leg 101B after a time delay and with the same operational condition prevailing; therefore, the operational sequence for only leg 101A is explained hereinafter.

When said former bracket 44 is being moved from position III' to position IV', said finger pieces 31 and 32 are further advanced toward said sewing machine 89, until the line on the toe part of leg 101A of said material 101 to be stitched thereon enters into the stitching position of said sewing machine 89. By laterally moving said finger pieces 31 and 32 together with said leg 101A as well as by the operation of said sewing machine, a stitched line 5 is formed in said toe part of the leg 101A, and also a cut edge is formed on said toe part of the leg 101A.

When said former bracket 44 is being moved from the position IV' to the position V', said finger pieces 31 and 32 are moved far from said sewing machine and are also retracted into a member of the suction tube 30.

When the former and latter brackets pass through the positions VII' and VIII', respectively, the toes of said legs 101A, 101B of said toe-closed seamless panty hose are sucked into said suction tubes 30, respectively, by a pneumatic force of the suction tubes 131A and 131B as shown in FIG. 18. Then, some parts of the legs 101A, 101B remaining on said holding units are sucked into said suction tubes 30, so that said parts are turned from inside-out, by means of a two pairs of drawing-in rollers 121, and back to their original sides.

When the former and latter brackets pass through the positions IX' and X', respectively, said toe-closed legs 101A, 101B with their correct sides out are simultaneously removed from the suction tubes 30, so that the toe-closed seamless panty hose material 101 can be pneumatically transported to the downstream working station by means of the suction tube 132.

If both legs 101A, 101B of said seamless panty hose material 101 are to be toe-closed in the same fashion, in such case, then two of the adjacent suction tubes 30 mounted on one bracket 44 can be used.

What is claimed is:

1. Apparatus for closing seamless hose material comprising a stationarily disposed sewing machine;

a frame;

a plurality of holding members for holding a seamless hose material respectively thereon, said holding members being mounted on said frame for movement along said frame laterally to the front of said sewing machine;

a pair of finger pieces mounted on each said holding member, said pair of finger pieces having free ends and each finger piece having a projection at a respective free end which projects outwardly from a side of each said finger piece;

means for moving each respective finger piece of each pair of finger pieces laterally with respect to each other;

a hose guiding pin device moving synchronously along with each said holding member in a parallel direction, each said pin device being disposed between a respective pair of said finger pieces to fixedly support a seamless hose material at an intermediate region in such a manner that a one point engagement exists therebetween, whereby said engaging part of said material can be fixedly supported by said pin, and then said material together with a pair of finger pieces can be advanced toward said sewing machine, until the front edges of said finger pieces reach a stitching line by means of said sewing machine.

2. An apparatus as claimed in claim 1, wherein, said hose guiding pin device comprises, a hose guiding pin movably mounted so that the top of said pin can project above from the surface of the seamless stocking material; and a guide rail fixedly disposed above the material to be toe-closed and having a straight line groove in which said top of said pin engages for sliding along said groove, said groove having a length longer than the length of the stitching line on said seamless hose.

3. An apparatus as claimed in claim 2, which further comprises means for commencing engagement between said pin and hose material before said material reaches a position at which said material is to be positively deformed; said engagement is continued until said material reaches a position at which a straight line stitching on the material is completely accomplished; and said hose guiding pin moves together with said holding member along the travelling passage of said holding member.

4. An apparatus as claimed in claim 3, further comprising an endless chain holding said hose guiding pin device thereon for travel along an oval passage.

5. An apparatus as claimed in claim 3, further comprising:

a pin holder fixedly mounted on a supporting member, said holder holding said hose guiding pin for movement up and down within said holder and;

a straight line cam acting upon said pin.

6. An apparatus as claimed in claim 1, wherein said holding members are movable in an oval passage and said sewing machine is disposed midway along one side of a straight passage of said oval passage whereby said sewing machine can stitch to close said toe on said seamless hose.

7. An apparatus as claimed in claim 1, wherein a pair of holding members are arranged in such a way that two pieces of the hose material provided on one united panty hose can be mounted thereon.

8. An apparatus as claimed in claim 7, wherein each said pair of adjacent holding members are mounted on one supported bracket in a parallel arrangement.

* * * * *